United States Patent [19]

Abernethy

[11] Patent Number: 5,016,556

[45] Date of Patent: May 21, 1991

[54] SEA ANCHOR OR DROGUE

[76] Inventor: William J. Abernethy, Woodville, R.M.B. 128, Delegate, New South Wales 2633, Australia

[21] Appl. No.: 408,496

[22] PCT Filed: Feb. 15, 1988

[86] PCT No.: PCT/AU88/00041

§ 371 Date: Aug. 17, 1989

§ 102(e) Date: Aug. 17, 1989

[87] PCT Pub. No.: WO88/06117

PCT Pub. Date: Aug. 25, 1988

[30] Foreign Application Priority Data

Feb. 17, 1987 [AU] Australia ..... PI0398

[51] Int. Cl.[5] ..... B63B 21/48

[52] U.S. Cl. ..... 114/311; 114/294

[58] Field of Search ..... 114/293-311, 114/234; 441/13, 11; 244/138 R, 1 TD; D12/215

[56] References Cited

U.S. PATENT DOCUMENTS 3,064,613 11/1962 Hubick ..... 114/311
3,310,257 3/1967 Price ..... 244/1 TD
4,562,788 1/1986 Abernethy ..... 114/311

FOREIGN PATENT DOCUMENTS 1435960 12/1966 France ..... 244/1 TD

*Primary Examiner*—Ed Swinehart
*Attorney, Agent, or Firm*—Foley & Lardner

[57] ABSTRACT

A sea anchor comprising a hollow body having a front part and a rear part and at least one water outlet located adjacent to the rear end of the front part. The front part has water inlet openings, and the rear part is moveable relative to the front part between first and second positions. In the first position, the forward end of the rear part engages the rear end of the front part to close at least one water outlet. In the second position, the forward end of the rear part is separated from the rear end of the front part to define the water outlet. The front part contains attachment means for attaching a line for towing the body in a forward direction.

13 Claims, 7 Drawing Sheets

SEA ANCHOR OR DROGUE

Figure 1:
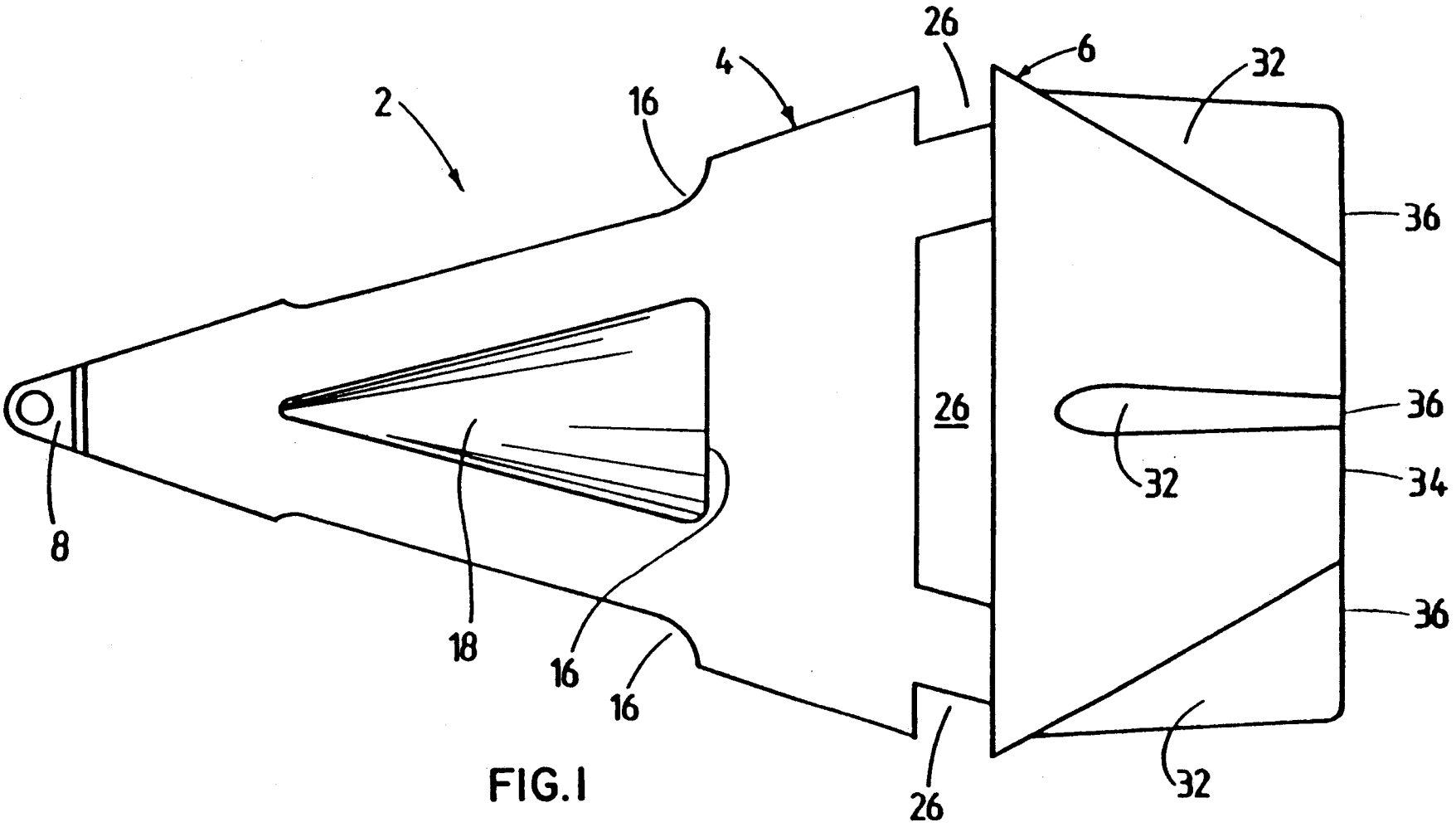

This invention relates to a drogue or sea anchor.

It is known from International Publication No. WO84/02111 to construct a sea anchor or drogue in the form of a generally hollow body having a conical front portion and a frustoconical rear portion from which extends stabilising vanes. A number of movable doors are provided in the front part which open at higher towing speeds as to expose the forward edges of the rear part of the body. This permits water to enter the interior of the body and considerably increases the drag of the device.

It is also known to construct a device similar to that described above in which the doors are fixed in an open position and a water outlet port is provided in the centre of the rear part. As the sea anchor is towed through the water, the exposed forward edge of the rear part directs water inwardly of the rear part and is expelled from the port.

The object of the invention is to provide a novel construction of sea anchor or drogue which is simple, effective and robust.

According to the present invention there is provided a sea anchor or drogue comprising:

a hollow body having a front part and a rear part;

said front part being generally conical in shape and said rear part being generally frustoconical in shape;

attachment means for attaching a line to the forward end of the front part for towing the body in a forward direction;

the front part having water inlet openings;

characterised in that the body includes at least one water outlet which is located adjacent to the rear end of the front part.

In one form of the invention, the water outlets are formed in the front part and are located adjacent to the rear end of said front part. Thus, the outlets of the invention are located, generally speaking, in positions corresponding to the inlets of known devices described earlier. In the device of the invention, the outlets are therefore located near the widest diameter part of the device and the water emerging therefrom as significant components in the radial direction. This tends to create considerable turbulence around the device and therefore increase the drag which it exerts on the towing line.

Preferably, the sea anchor or drogue includes secondary outlets which are located in the rear part of the device for permitting escape of streams of water in a generally rearward direction so as to stabilise the device as it is towed.

It is thought that at lower speeds of towing a relatively small volume of water enters the water inlet openings and a significant portion of water so admitted passes through the secondary outlets. In this mode the main drag exerted by the device is caused by water flowing over the external surface of the front part of the device. At higher speeds, more water enters the inlets and the major proportion of the admitted water will be expelled through the outlets located adjacent to the front and rear parts. This increases the drag exerted by the device. It is also thought that the streams of water passing through the outlets have the effect of deflecting streams of water passing along the surface of the front part further outwardly. This deflection is therefore functionally equivalent to increasing the diameter of the device and hence the amount of drag which it will exert on the towing line.

In an alternative embodiment, the rear part is movable relative to the front part. In one position, the front and rear parts engage one another whereby a relatively small amount of water will pass through the device and the drag exerted will be correspondingly low. As the speed increases, the rear part separates from the front part so as to open the main water outlet and in this mode the drag exerted will be higher.

Figure 2:
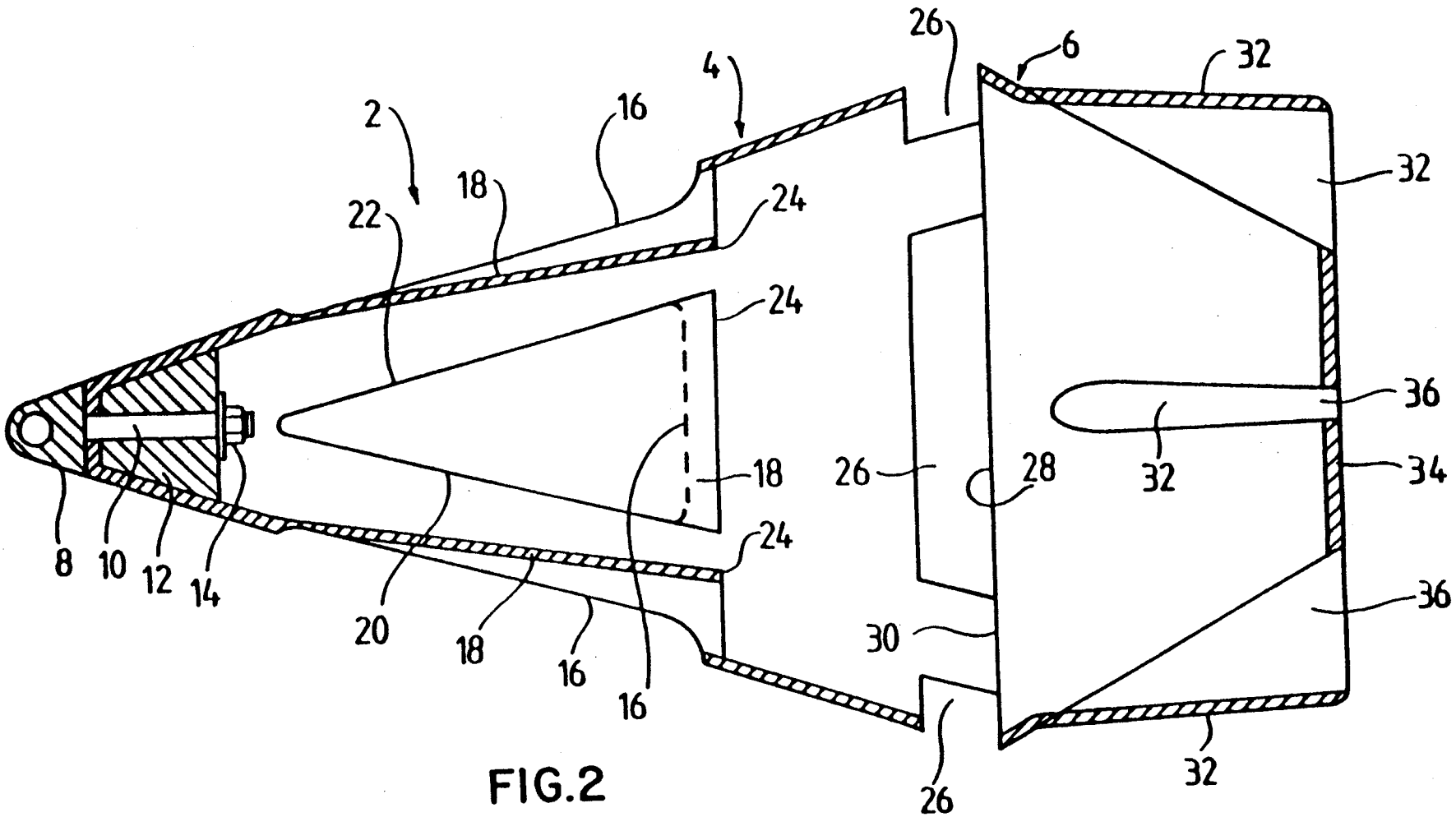
Figure 3:
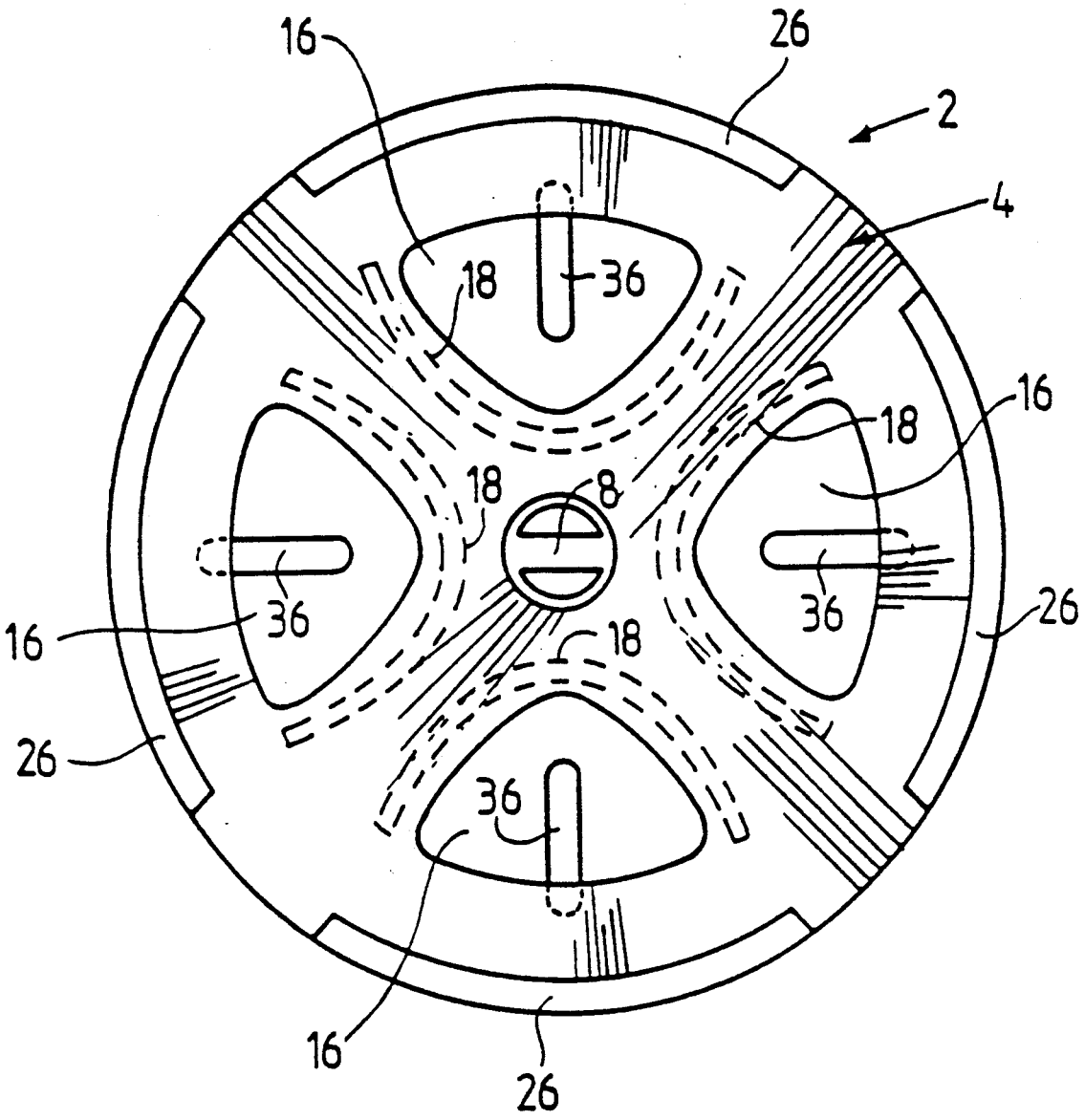
Figure 4:
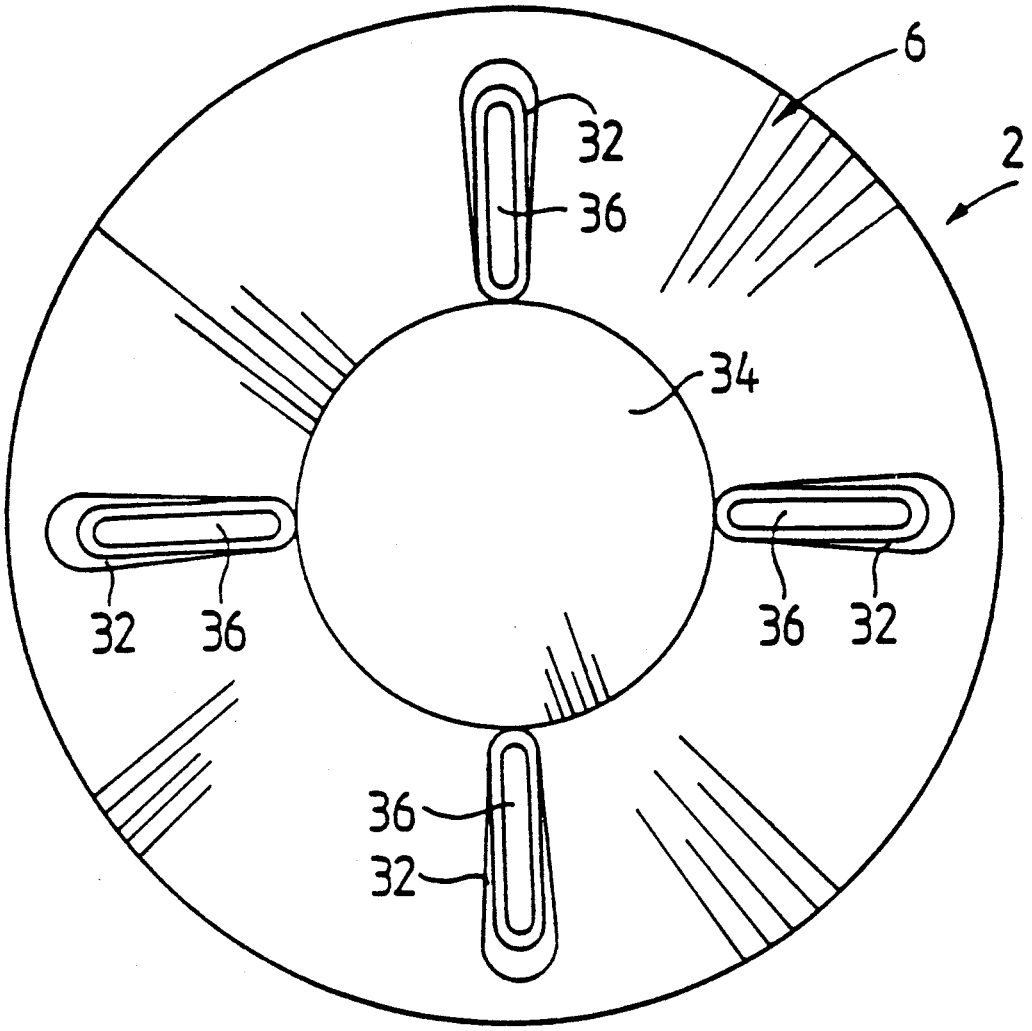
Figure 5:
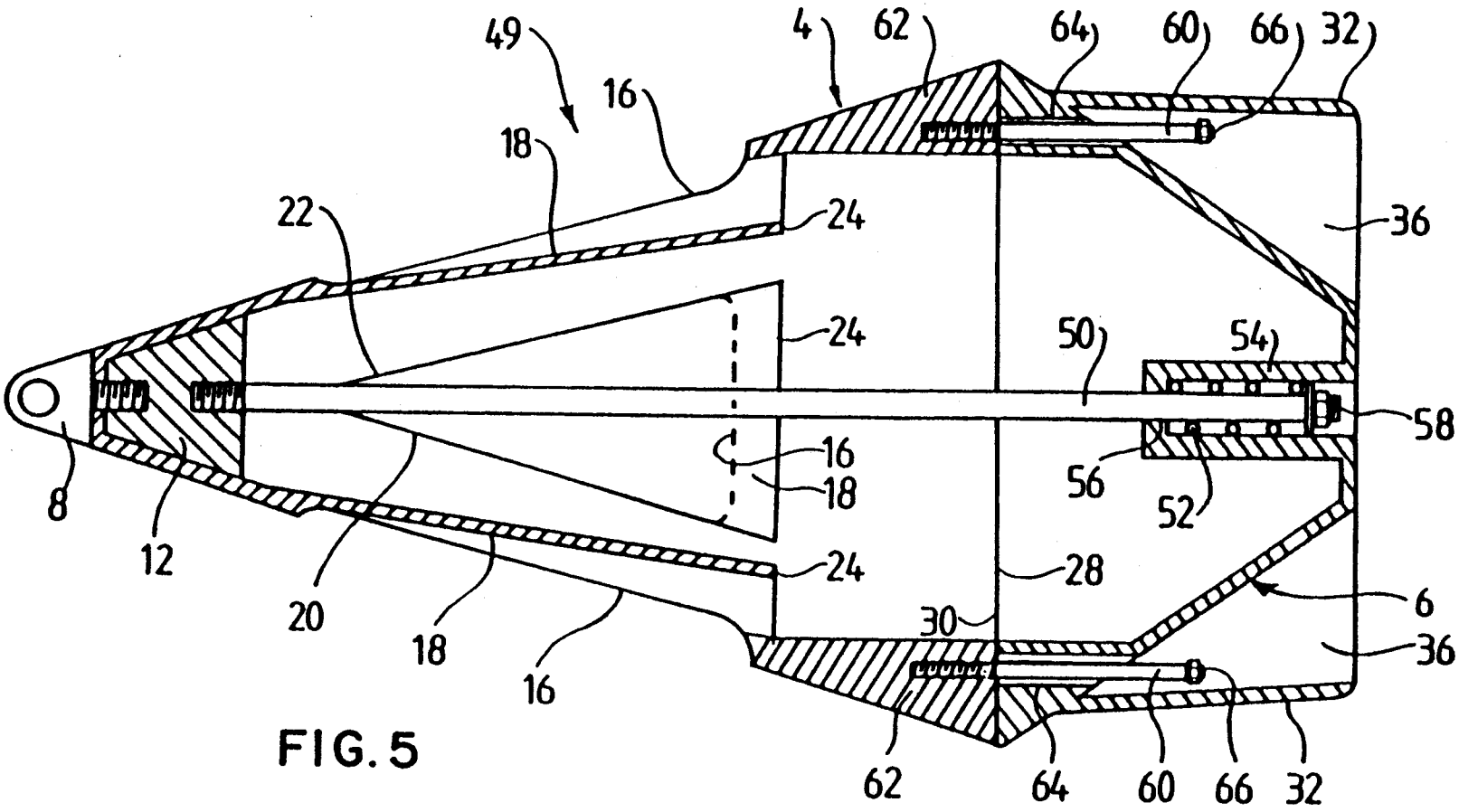
Figure 6:
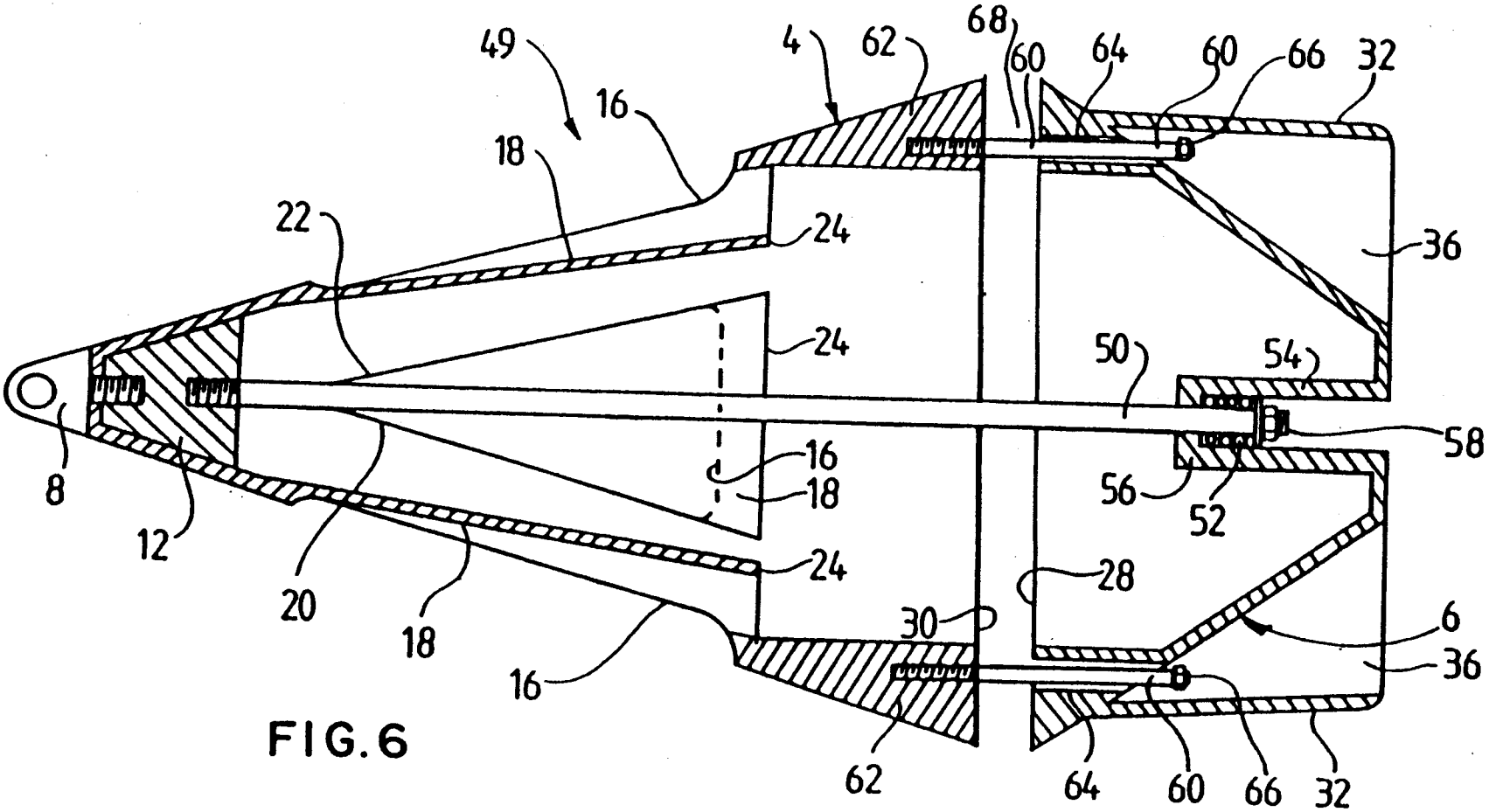
Figure 7:
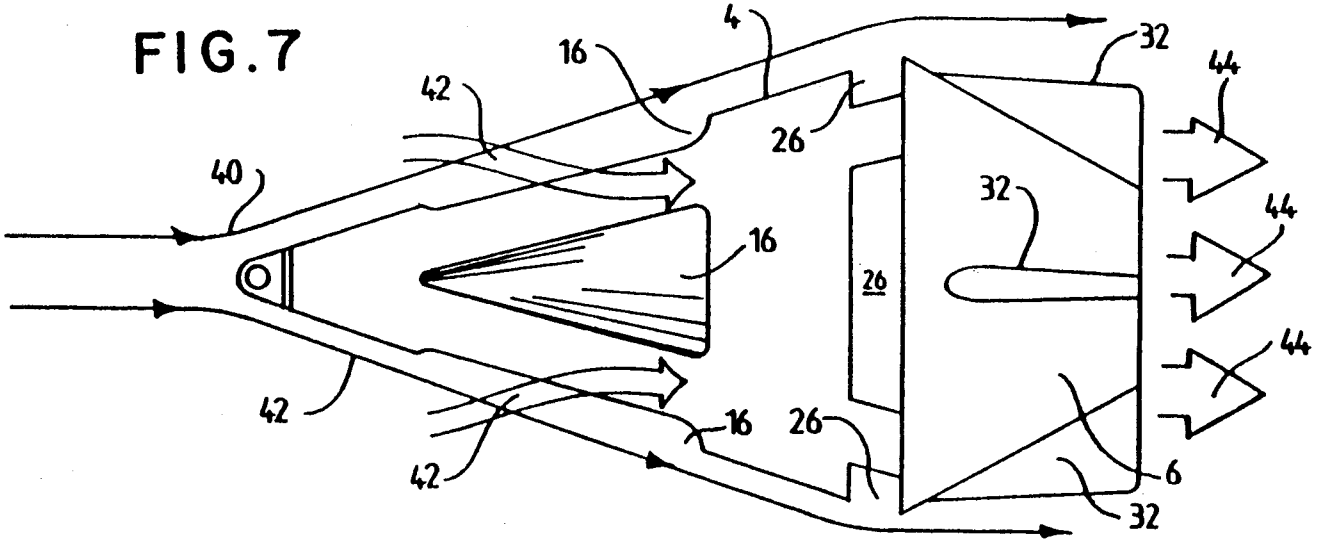
Figure 8:
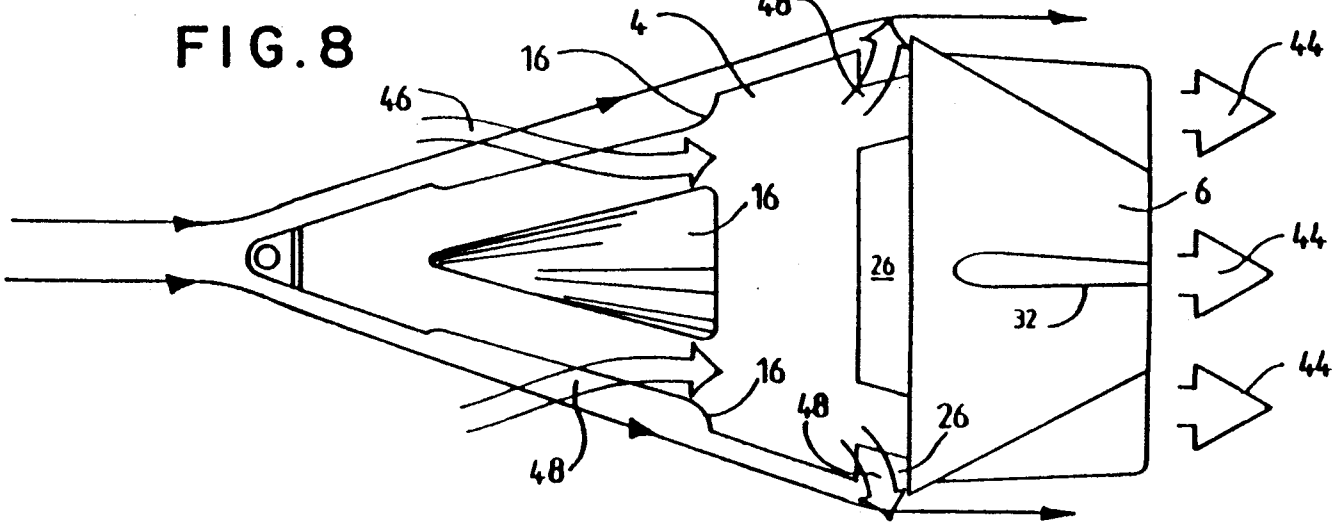

The invention will now be further described with reference to the accompanying drawings:

FIG. 1 is a side view of a sea anchor or drogue constructed in accordance with the invention, FIG. 2 is a longitudinal section through the device, FIG. 3 is a frontal view of the device, FIG. 4 is a rear view of the device, FIG. 5 is a longitudinal section through a second embodiment of the invention, FIG. 6 shows the embodiment of FIG. 5 with the main outlet open, FIG. 7 diagrammatically illustrates the operation of the device at low towing speeds, and FIG. 8 diagrammatically illustrates the operation of the invention at higher towing speeds.

The sea anchor or drogue illustrated in FIGS. 1 to 4 comprises a generally hollow body 2 having a generally conical forward part 4 and frustoconical rear part 6. The front and rear parts may be integrally formed from plastics material by rotational moulding or may be formed separately by known moulding techniques and joined together.

The forward part 4 has an apex angle in the range of 20° to 90° and is preferably about 40°. The apex angle of the rear part is in the range of 20° to 90° and preferably about 60°. The forward end of the front part 4 has connected thereto an eyelet 8 to which a towing hauser (not shown) is connected. A stud 10 extends from the eyelet 8 into the forward part 4 of the device. A ballast 12 is mounted on the stud 10 and is retained in position by means of a nut 14. The forward part 4 includes four or more generally triangular inlet openings 16 which are symmetrically disposed about the conical surface, as best seen in FIG. 3. Each inlet opening has associated therewith a guide surface 18. The guide surfaces 18 are preferably part cylindrical and are located inwardly of their respective openings 16. The side edges 20 and 22 of the surfaces 18 are joined to the inside surface of the body 4, as best seen in FIG. 2. The rear edges 24 of the guide surfaces 18 are free and are located near the rear ends of the openings 16. As the device is towed through water, streams of water will enter the openings 16 and will be directed in a generally axial direction by the guide surfaces 18 towards the rear part 6.

The front part 4 also includes four openings 26 which are aligned with openings 16, as best seen in FIGS. 1 and 3. The forward edge 28 of the rear part 6 forms part of the perimeter of the openings 26, as seen in FIG. 2. The forward edge 28 of the rear part 6 is of the same diameter as the rear edge 30 of the front part 4. Thus the forward edge 28 does not act as a scoop to draw water into the rear part 6 of the device. The outlets 26 could alternatively be located partly or wholly in the rear part 6, adjacent to its forward edge 28.

The rear part 6 is integrally formed with four or more vanes 32 which project outwardly and terminate generally in the same plane as the end wall 34 of the rear part 6. The vanes 32 are hollow and have secondary water outlets 36 at their rear ends.

In the device of the invention, the combined area of the forward openings 16 is selected so as to be considerably larger than the combined area of the outlets 26. The combined area of the outlets 36 in the fins 32 is relatively small by comparision with the openings 16 and outlets 26. It will be appreciated that because of the differences in areas of the inlets and outlets, water from the outlets will have a higher velocity than the water entering the inlets.

When the device is towed at relatively low speeds, it is thought that a significant part of the drag exerted by the device is caused by water flowing along the conical outer surface of the front part 4. At lower speeds, a relatively small volume of water will enter the openings 16 and it is thought that most of this will pass through the outlets 36 rather than through the outlets 26. The reason for this is that the water will be directed generally towards the outlets 36 and the flow rates are such that it is easier for the water to pass directly to the outlets 36 rather than being diverted laterally through the outlets 26. This is diagrammatically illustrated in FIG. 7 which shows streamlines 50 which are generally parallel to the conical surface of forward part 4. The diagram shows streams of water entering the inlets 16 and emerging as outlet streams 44 from the outlets 36. The streams 44 together with the vanes 32 assist in stabilising the towing position of the device that is to say to prevent the device from tracking from one side to another. The streams and vanes also tend to prevent rotation of the device about its longitudinal axis.

At higher speeds, more water enters the openings 16, as indicated by streams 46 shown in FIG. 8. The higher volume flows of water will not be able to escape through the outlets 36 and laterally extending outlet streams 48 will emerge from the outlets 26. It will be seen that the streamlines 46 are caused to be deflected outwardly by the streams 48 and this has the effect of increasing the drag on the towing line. Any turbulence in the vicinity of the streams 48 also has the effect of increasing the drag. It will be appreciated that the effect of the laterally emerging streams 48 is functionally equivalent to increasing the base diameter of the forward part 4.

A prototype device has been tested and the following test results were obtained.

| SPEED (Knots) | DRAG (Kgs) |
|---|---|
| 6.47 | 65 |
| 8.00 | 85 |
| 8.25 | 105 |
| 9.08 | 130 |
| 13.33 | 200 |

The prototype device was approximately 300 mm in diameter with a length of about 570 mm. The area of each inlet 16 was approximately 110 sq.cm and the area of each outlet 26 was about 60 sq.cm. The outlets 36 were about 6 sq.cm. The weight of the device as tested was 4.5 kgs. including 1.5 kgs. as the ballast 12. The device performed very satisfactorily and did not require a chain to be connected to the hauser to keep the nose of the device down.

It is preferred that the ratio of the areas of the openings 16, 26 and 36 be approximately in the following ratio 18:10:1. These areas can be varied by about 25% and satisfactory results obtained.

FIGS. 5 and 6 illustrate a modified sea anchor or drogue 49 of the invention. Parts which correspond to those of the embodiment of FIGS. 1 to 4 have the same reference numerals and need not be described again. The principal difference between the embodiment of FIGS. 5 and 6 and that of FIGS. 1 to 4 is that the rear part 6 is movable relative to the front part 4 and the openings 26 are omitted. The device includes a central elongate shaft 50 extending rearwardly from the ballast 12. The rear part 6 is mounted for sliding movement on the shaft 50 and is biased by means of a compression spring 52 so that its forward edge 28 engages the rear edge 30 of the forward part 4. The spring 52 is located in a mounting boss 54 which extends inwardly from the end wall 34 of the rear part 6. The inner end wall of the boss 54 includes a bore 56 through which the shaft 50 passes. The initial tension on the spring 52 can be adjusted by means of a nut 58. The device includes guide bolts 60 which extend rearwardly from mounting portions 62 formed towards the rear end of the forward part 4. The guide bolts 60 pass through bores 64 formed in near the forward edge of the rear part 6. The heads 66 of the bolts 60 are located within the hollow vanes 32. The guide bolts 60 assist in constraining the rear part 6 to axial movement relative to the front part 4 on the shaft 50.

When the device is towed at low speeds, relatively small volumes of water will enter the openings 16 and be expelled through the openings 36. The drag exerted by the device will be relatively small and will be primarily due to water flowing externally of the body.

At higher speeds, the internal pressure within the body will increase to a point where the biasing force of the spring 52 will be overcome and the rear part 6 will move rearwardly, as shown in FIG. 6. This causes an opening 68 to be formed between the front and rear parts, the opening 68 functioning analogously to the openings 26 of the embodiment of FIGS. 1 to 4. The position of the heads 66 of the bolts determines the width of the openings 68. The position of the heads 66 can be adjusted by the user to give a wider or narrower gap 68 for more or less drag at higher towing speeds.

Many modifications will be apparent to those skilled in the art without departing from the spirit and scope of the invention.

What is claimed is:

1. A sea anchor or drogue comprising:

a hollow body having a front part having rear and forward ends, a rear part having a forward end, and at least one water outlet located adjacent to the rear end of the front part;

said front part having water inlet openings and being generally conical in shape;

said rear part being generally frustoconical in shape and movable relative to the front part between first and second positions and wherein, in the first position, the forward end of the rear part engages the rear end of said front part and said at least one water outlet is closed, and wherein, in the second position, the forward end of the rear part is separated from the rear end of said front part to thereby define said at least one water outlet, and attachment means for attaching a line to the forward end of the front part for towing the body in a forward direction.

2. A sea anchor or drogue as claimed in claim 1, further including biasing means for biasing the rear part to its first position, the biasing means being such that when the towing speed reaches a predetermined level the rear part moves towards its second position.

3. A sea anchor or drogue as claimed in claim 1, further including guide means for guiding the movement of the rear part between said first and second positions.

4. A sea anchor or drogue as claimed in claim 3, wherein the guide means includes a central shaft which extends rearwardly from the forward end of the front part and guide shafts which project rearwardly beyond the rear end of the front part.

5. A sea anchor or drogue as claimed in claim 1, wherein the rear part includes secondary water outlets for permitting escape of water from the body in streams which are rearwardly directed so as to stabilize the sea anchor or drogue as it is towed.

6. A sea anchor or drogue as claimed in claim 5, wherein the rear part includes projecting fins and said secondary outlets are located at the rearward ends of the fins.

7. A sea anchor or drogue as claimed in claim 5, wherein the water inlet openings and said at least one outlet are symmetrically disposed about said front part, and said secondary water outlets are symmetrically disposed about the rear part.

8. A sea anchor or drogue as claimed in claim 5, further including guide surfaces located within the front part and adjacent to said inlet openings, said guide surfaces being operable to direct water passing into said inlet openings generally axially of said front part and towards said rear part.

9. A sea anchor or drogue as claimed in claim 1, wherein the total area of the inlet openings is greater than the total area of said at least one water outlet.

10. A sea anchor or drogue as claimed in claim 9, wherein the ratio of the total areas of the inlet openings to said at least one water outlet is about 18:10.

11. A sea anchor or drogue as claimed in claim 1, wherein the ratio of the total areas of the inlet openings, said at least one water outlet, and said secondary water outlets is about 18:10:1.

12. A sea anchor or drogue as claimed in claim 1, wherein said conical front and said frustoconical rear parts have apex angles in the range of 20° to 90°.

13. A sea anchor or drogue as claimed in claim 1, further including a ballast in the front part.

* * * * *